US008286562B2

(12) United States Patent
Reynard

(10) Patent No.: US 8,286,562 B2
(45) Date of Patent: Oct. 16, 2012

(54) TRANSPORTABLE LOAD CARRYING PLATFORM

(75) Inventor: Kenneth Reynard, Thirsk (GB)

(73) Assignee: Duraloc Limited, North Yorkshire (GB)

( * ) Notice: Subject to any disclaimer, the term of this patent is extended or adjusted under 35 U.S.C. 154(b) by 656 days.

(21) Appl. No.: 12/162,115

(22) PCT Filed: Jan. 19, 2007

(86) PCT No.: PCT/GB2007/000179

§ 371 (c)(1),
(2), (4) Date: Nov. 21, 2008

(87) PCT Pub. No.: WO2007/085801

PCT Pub. Date: Aug. 2, 2007

(65) Prior Publication Data

US 2010/0043677 A1 Feb. 25, 2010

(30) Foreign Application Priority Data

Jan. 24, 2006 (GB) ..... 0601375.9

(51) Int. Cl.
*B65D 19/44* (2006.01)

(52) U.S. Cl. ..... 108/55.1

(58) Field of Classification Search ..... 108/51.11, 108/53.1, 54.1, 55.1, 56.1
See application file for complete search history.

(56) References Cited

FOREIGN PATENT DOCUMENTS

| | | | |
|---|---|---|---|
| EP | 1197447 | A1 | 4/2002 |
| GB | 2211169 | A | 6/1989 |
| WO | WO 2004/106678 | A1 | 12/2004 |

OTHER PUBLICATIONS

PCT International Search Report for PCT/GB2007/000179, dated Apr. 26, 2007, 4 pages.

*Primary Examiner* — Jose V Chen
*Assistant Examiner* — Matthew Ing
(74) *Attorney, Agent, or Firm* — Howard & Howard Attorneys PLLC

(57) ABSTRACT

A transportable load carrying platform (10) comprising: a base frame (11); a pair of end walls (12) mounted one at each of two opposed ends of the base frame (11), said end walls being adjustable between operative positions in which the end walls (12) extend upwardly from the base frame (11) and inoperative positions in which the end walls (12) extend generally parallel to the base frame (11); a pivot mounting (18) on the base frame (11) defining a pivot axis (19) about which one of said end walls (12) is mounted for pivotal movement from the inoperative position and towards the operative position; cooperating abutment faces (23, 24) on the base frame (11) and said one end wall (12) which inter-engage, when the end wall takes up its operative position; and means for displacing the pivot axis (19) laterally whereby the movement of the end wall from its inoperative position to its operative position is a 2-part movement comprising initial pivotal movement about the pivot axis (19) followed by lateral displacement of the pivot axis (19) to bring cooperative abutment faces (23, 24) into engagement.

5 Claims, 5 Drawing Sheets

TRANSPORTABLE LOAD CARRYING PLATFORM

The subject patent application claims priority to and all the benefits of International Application No. PCT/GB2007/000179, which was filed on Jan. 19, 2007 with the World Intellectual Property Organization.

This invention relates to a transportable load carrying platform having a base frame for supporting a load, and a pair of end walls mounted one at each of two ends of the base frame, in which the end walls are adjustable between operative positions in which the end walls extend upwardly from the base frame when a load is being supported by the base frame so that the loaded platform can be transported with the end walls in the operative position, and inoperative positions in which the end walls extend generally parallel to the base frame so as to reduce the overall height of the platform and thereby enable the unloaded platform to be stacked with other unloaded platforms to form a transportable stack of unloaded platforms.

A transportable load carrying platform of the type with which the invention is concerned is referred to generally in the art, namely the transport of freight, as a "folding end flat rack", and which have been made and used for many years for transport/shipping of heavy or irregular shaped cargo which cannot be loaded into a normal ISO shipping container. Usually, the load is lashed down to the base frame of the platform, and the platform is transported with the end walls in the operative position. The platform is capable of being handled readily in this manner, including transit to a dock, transfer to a ship and onward sailing to the port of destination, transfer again to a vehicle or rail wagon, and transit to final destination. Alternatively, the load can be transferred at the port to a suitable load carrier for final transport to the eventual destination. In either event, for the return empty journey of the platform, the end walls are folded downwardly to the inoperative positions, so that stacks of unloaded platforms or "racks" can be formed and locked together for transport as stacks of empty units forming standard ISO modules.

The end walls are usually pivotally mounted at the ends of the base frame, and are locked in their operative positions. The locking of the end walls in the operative positions usually is obtained by operation of "shoot bolts" or the like which are mounted on the base frame, a small distance only above the pivots on which the end walls are mounted, and which are slid into receiving holes provided in the end walls after the walls have been pivoted upwardly through approximately 90° from the inoperative positions.

Given that the loads are usually lashed down firmly to the base frame, so that the loads will not normally be liable to move along the base frame in use, the end walls are unlikely to be exposed to any impact from the load during transport, and therefore the fact that only a small resisting moment is available to prevent pivoting of the end walls from the operative positions (because of the close spacing of the shoot bolts above the pivots) it is not generally a problem as far as the load is concerned. However, in the event of rough handling of the loaded platform, and/or when it is loaded on a ship adjacent to other loaded platforms during stormy weather, there is a risk of impacts being applied to the end walls and possible failure, or progressive damage being done to the shoot bolt locking of the end walls.

For this reason, it is necessary for regular inspection, and maintenance when necessary, to be carried out of the platforms. This is a substantial labour and material cost burden to be bourne by users of existing types of load carrying platforms (racks).

The invention addresses this problem, and seeks to provide an improved hinge assembly for mounting an end wall at one end of a base frame of a load carrying platform, and which is simple to operate and yet provides significantly greater resistance to damage in the event of impact being applied to the end wall.

According to the invention there is provided a transportable load carrying platform comprising:

a base frame for supporting a load;

a pair of end walls mounted one at each of two opposed ends of the base frame, said end walls being adjustable between operative positions in which the end walls extend upwardly from the base frame when a load is being supported by the base frame so that the loaded platform can be transported with the end walls in the operative positions, and inoperative positions in which the end walls extend generally parallel to the base frame so as to reduce the overall height of the platform and thereby enable the unloaded platform to be stacked with other unloaded platforms to form a transportable stack of unloaded platforms;

a pivot mounting on the base frame defining a pivot axis about which one of said end walls is mounted for pivotal movement from the inoperative position and towards the operative position;

cooperating abutment faces on the base frame and said one end wall which inter-engage, when the end wall takes up its operative position, in order to resist any lateral impact applied to the end wall; and means for displacing the pivot axis laterally whereby the movement of said one end wall from its inoperative position to its operative position is a 2-part movement comprising initial pivotal movement about the pivot axis followed by lateral displacement of the pivot axis to bring the cooperative abutment faces into engagement.

The invention therefore provides a transportable load carrying platform, with a base frame and opposed end walls, in which at least one of the end walls can be simply manipulated, preferably manually, to be adjusted from its operative to its operative position, and when in the operative position, the inter-engaging abutment faces provide a substantial moment about the pivot axis available to resist the effect of any lateral impact which may be applied in use to the end wall.

Preferably, the pivot mounting comprises a pivot pin mounted on the base frame and defining the pivot axis about which said one end wall is pivotable via a socket in the end wall which receives the pivot pin, whereby the instantaneous contact area between the pivot pin and the socket also provides substantial resistance to the effect of application of any lateral impact to the end wall.

Conveniently, the pivot pin forms part of an eccentric arrangement which is rotatable in order to displace the pivot axis laterally to move the cooperating abutting faces into and out of engagement respectively during movement to and from the operative position, and thereby to form a particularly preferred from of said means for displacing the pivot axis laterally.

The eccentric arrangement may be manually adjustable, whereby the two part adjustment movement of said one end wall, between its inoperative and operative positions, can be carried out entirely by manual manipulation.

Preferably, releasable latching and/or locking arrangements may be provided to hold the end wall in its operative and inoperative positions.

In a preferred embodiment of the invention, each end wall is adjustable between its operative and inoperative positions by the two part adjustment movement referred to above.

A preferring embodiment of load carrying platform according to the invention will now be described in detail, by way of example only, with reference to the accompanying drawings, in which:

FIGS. 1*a*, 1*b*, 1*c*, and 1*d* are, respectively, plan, side, front and rear elevation views of a known load carrying platform, which will be described in order to provide background to the description of the preferred embodiment;

Figure 4:
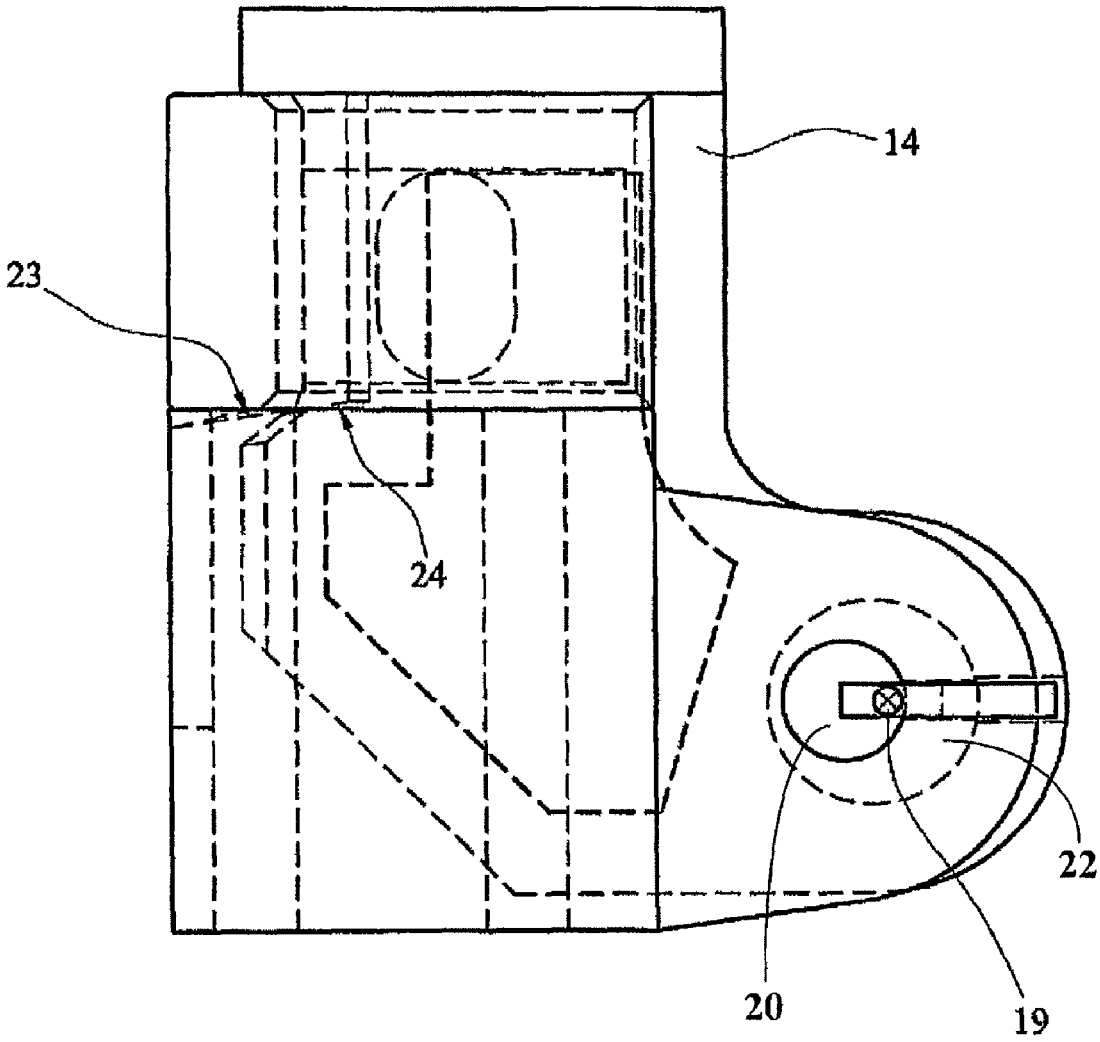
Figure 5:
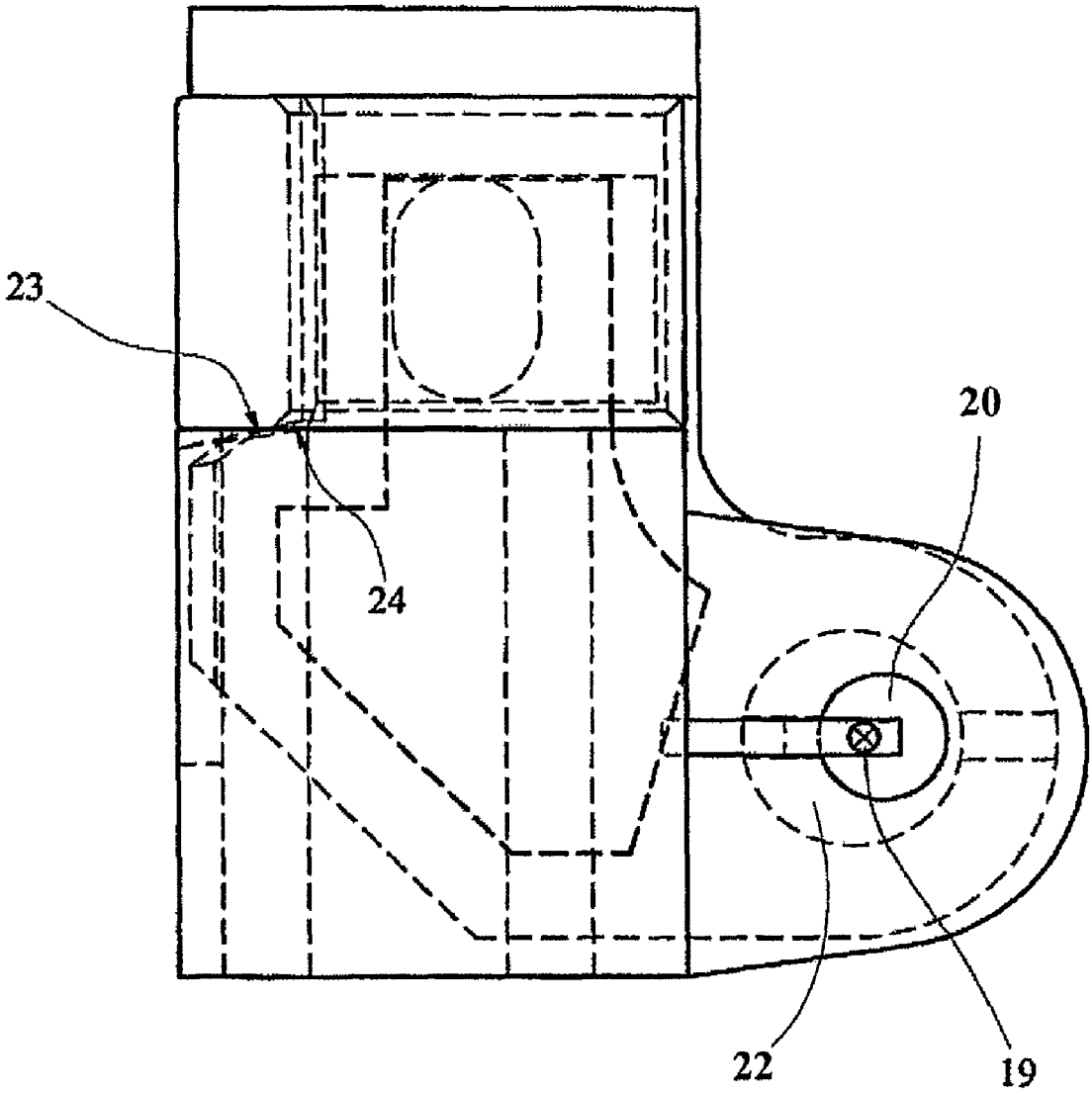

FIG. 4 is a side view of the pivot mounting, after upward adjustment of the end wall to an upright position close to its final locked operative position; and FIG. 5 is a view, similar to FIG. 4, showing the end wall after lateral displacement of the pivot axis so as to take up a stable engaged position in which it is able to resist strongly the effect of application of any lateral impact load in use to the end wall.

Referring first to FIGS. 1*a-d* of the drawings, an existing design of load carrying platform or "folding end flat rack" will first be described, by way of background to the description of the preferred embodiment.

A transportable load carrying platform is therefore designated generally by reference 10 and comprises a base frame 11 for supporting a load (not shown), such load being a large piece of machinery, or irregular cargo, not capable of being shipped in a standard ISO container. The load will nonnally be lashed down firmly to the base frame 11.

Figure 1C:
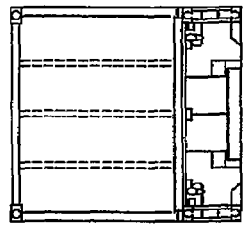
Figure 1D:
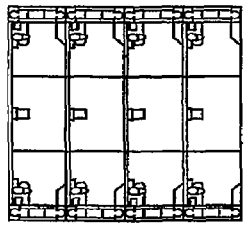
Figure 1B:
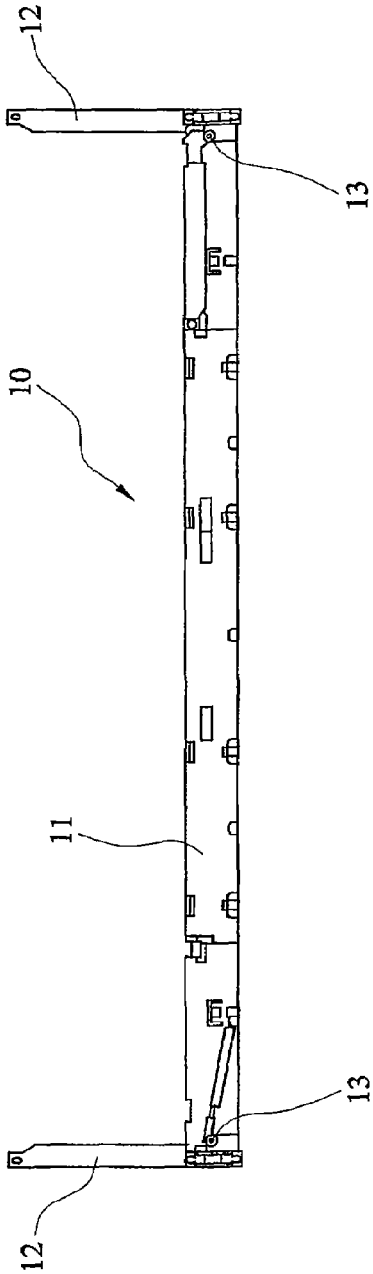

A pair of end walls 12 are mounted one at each of two opposed ends of the base frame 11, such end walls being adjustable between operative positions shown in FIG. 1*b*, in which the walls extend upwardly from the base frame 11 when a load is being supported by the base frame, so that the loaded platform 10 can be transported with the end walls locked in the operative positions.

Figure 1A:
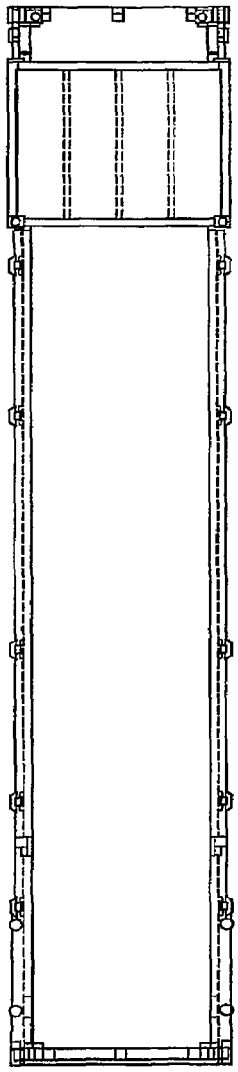

The end walls 12 can also take up inoperative positions, as shown for the right hand end wall 12 in FIGS. 1*a* and 1*b*, in which the end walls 12 extend generally parallel to, and overlie the base frame 11, so as to reduce the overall height of the platform 10 and thereby enable the unloaded platform to be stacked with other unloaded platforms to form a transportable stack of unloaded platforms for the return journey.

The end walls 12 can pivot upwardly and downwardly about pivot pins 20, and when they reach the upwardly extending operative position, after pivoting through approximately 90°, the end walls 12 are then locked in position by operation of shoot bolts (not shown) or the like which are mounted on the base frame 11, and which are slid horizontally so as to be received by receiving sockets provided in the lower ends of the end walls 12.

Having now described a typical existing design of load carrying platform, with reference to FIGS. 1*a* to 1*d*, to serve as background, a preferred embodiment of the invention will now be described with reference to FIGS. 2 to 5.

FIGS. 2 to 5 show in detail a pivot mounting provided at one end of the base frame 11, and illustrates only an adjacent end part 14 of one of the end walls 12. A short mounting post 15 is provided at each corner of one end of the base frame 11, and on which is rigidly mounted a standard coupling block 16 with entrance slots 17 allowing twistlock or other types of inter-connectors to join adjacent platforms together.

Figure 2:
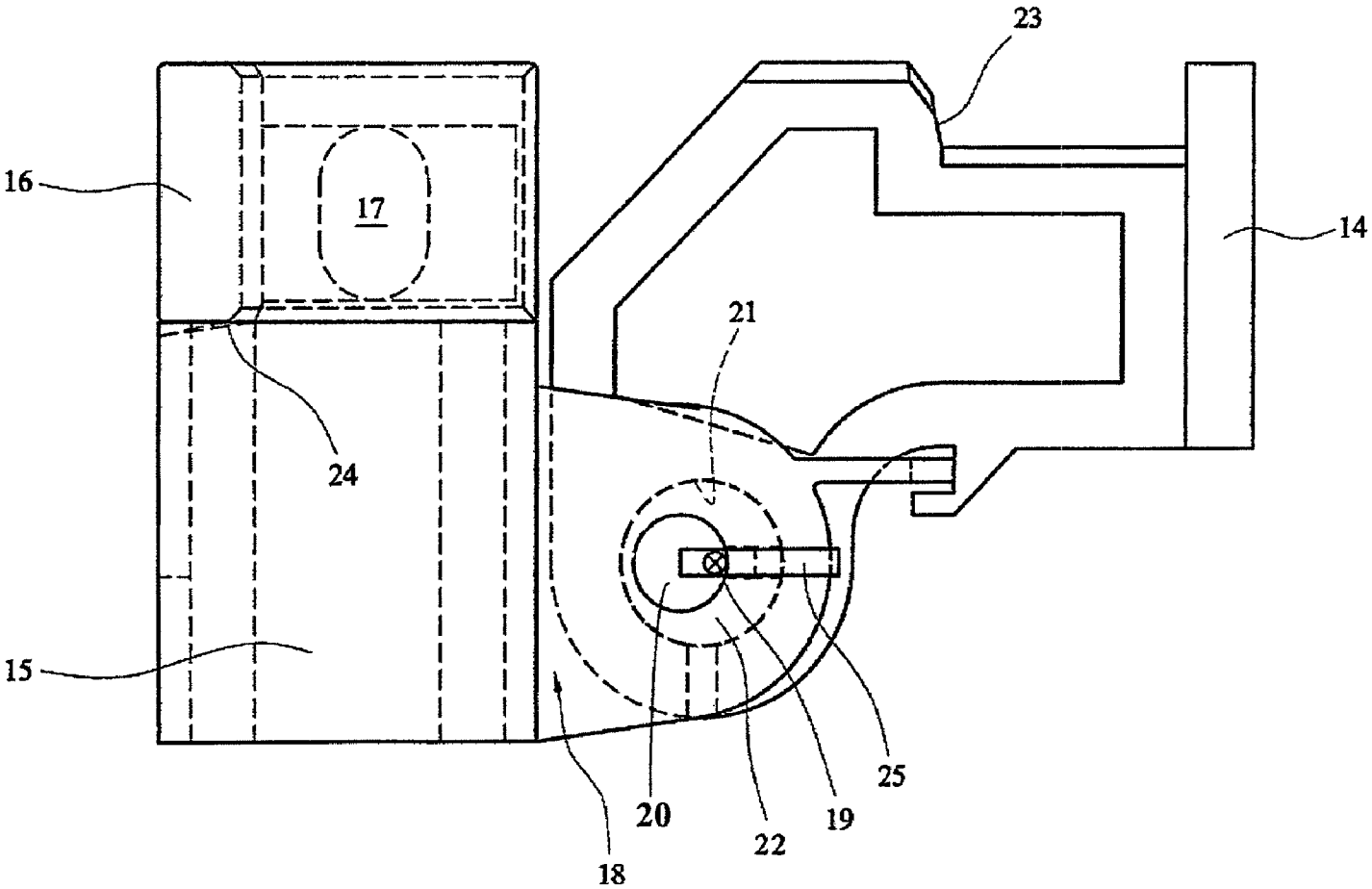
FIG. 2 is a side view of a pivotable mounting assembly for an end wall of a load carrying platform according to the invention, and showing one end wall in an inoperative position extending generally parallel to and overlying a base frame of the platform, and with a pivot mounting of the end wall in an outwardly displaced position of its pivot axis.
Figure 3:
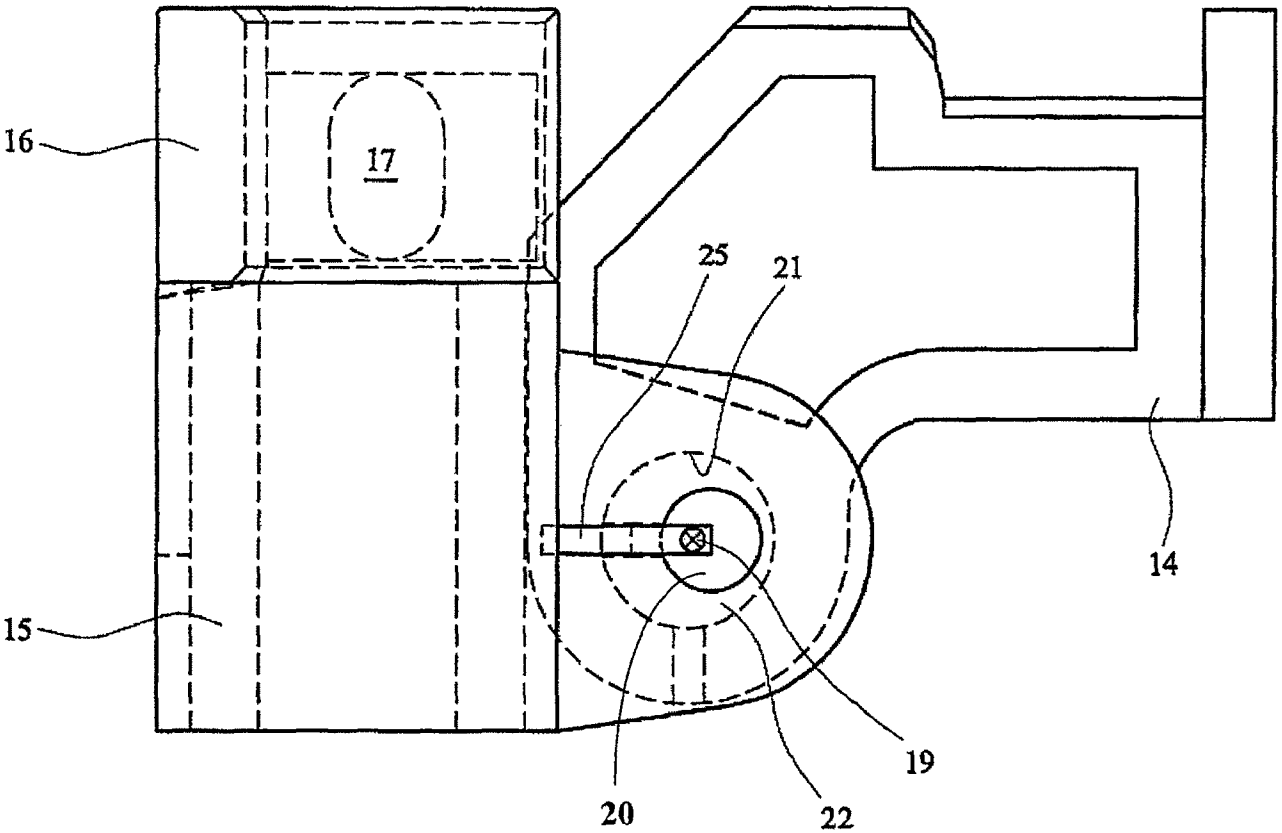
FIG. 3 is a view, similar to FIG. 2, but showing a lateral displacement of the pivot axis to an alternative position.

The pivot mounting which is secured firmly to post 15 is designated generally by reference 18, and defines a pivot axis 19 about which end wall 12 is mounted for pivotal movement between the inoperative positions shown in FIGS. 2 and 3, and towards the operative positions shown in FIG. 5.

The pivot mounting 18 comprises a pivot pin 20 mounted on the base frame 11 and defining the pivot axis 19 via its longitudinal centre line, and about which the end part 14 of end wall 12 is pivotable via a cylindrical socket 21 which receives the pivot pin 20.

The pivot pin 20 forms part of an eccentric arrangement 22 which is rotatable in order to displace the pivot axis 19 laterally, as can be seen from viewing FIG. 2 which shows the pivot axis 19 in one laterally displaced position, and FIG. 3 which shows an alternative laterally displaced position of the pivot axis 19, in which the entire end wall 12 moves horizontally i.e. parallel to the surface of the base frame 11, a small distance towards the post 15.

FIGS. 4 and 5 also show laterally displaced positions of the pivot axis 19, when the end walls have been upwardly pivoted to positions extending generally perpendicularly from the base frame 11. The purpose of provision for lateral displacement of the pivot axis 19 will be described in more detail below.

Cooperating abutment faces 23 and 24 are provided on the end wall part 14 and the base frame 11, and which are intended to inter-engage, when the end wall 12 takes up its operative position, in order to resist any lateral impact applied to the end wall in use.

FIG. 4 shows the end wall part 14 after upward adjustment through 90° to an upright position, but which is not yet the fully engaged stable operative position, as it can be seen that contact faces 23 and 24 are not quite yet moved relatively into inter-engagement. This is achieved by lateral displacement of the pivot axis 19 from the position shown in FIG. 4 to that shown in FIG. 5, whereby the contact faces 23 and 24 move into firm abutment with each other.

The eccentric arrangement 22 therefore forms a preferred example of provision of means for displacing the pivot axis 19 laterally whereby the movement of the end wall 12 from its inoperative position to its operative position is a two part movement comprising initial pivotal movement upwardly about the pivot axis 19, followed by lateral displacement of the pivot axis 19 to bring the cooperative abutment faces 23, 24 into engagement.

In the preferred example, the eccentric arrangement 22 comprises a knob or lever 25 which can carry out part orbital movement through a semi-circle between the inner and outward laterally displaced positions of pivot axis 19, as evident from FIGS. 2 and 3, or FIGS. 4 and 5.

Any suitable releasable latching and/or locking arrangements (not shown in detail) may be provided, to hold the end wall 12 in its operative position, and its inoperative position.

In the preferred embodiment, four pivot mountings 18 will be provided at each corner of the base frame 11, in order to pivotally mount both end walls 12 for two-part upward and downward pivotal adjustment plus lateral displacement of the pivot axis) between the operative and inoperative positions.

It has been found that the design of "folding flatrack" disclosed herein can meet required loading standards, and particularly the requirement that the top end of the end walls can withstand longitudinal loads of up to 7,500 kg and transverse loads of up to 15,000 kg.

Alternatively hinge assemblies are possible, within the scope of the claimed invention, and including provision of two pivotal arms coming up either side of a central casting.

The invention claimed is:

1. A transportable load carrying platform comprising:

a base frame for supporting a load with said base frame having two opposed ends;

a pair of end walls mounted one at each of the two opposed ends of the base frame, said end walls each being adjustable between an operative position in which the end walls extend upwardly from the base frame when the load is being supported by the base frame so that the platform can be transported with the end walls in the operative position, and an inoperative position in which the end walls extend generally parallel to the base frame so as to reduce an overall height of the platform and thereby enable an unloaded platform to be stacked with other unloaded platforms to form a transportable stack of unloaded platforms for a return journey;

a pivot mounting on the base frame about which one of said end walls is mounted for pivotal movement from the inoperative position and towards the operative position;

cooperating abutment faces on the base frame and one of said end walls which inter-engage, when one of the end walls takes up the operative position, in order to resist any lateral impact applied in use to the end wall;

a pivot pin disposed in the end wall with the pivot pin defining a pivot axis about which the end wall is pivotable; and an eccentric pin coupled to and extending axially from the pivot pin parallel to the pivot axis with the eccentric pin mounted and rotatable within the pivot mounting and with the eccentric pin offset from the pivot axis such that the eccentric pin defines an eccentric axis which is spaced laterally from the pivot axis and with the eccentric pin coupling the end wall to the pivot mounting;

wherein inter engagement of the cooperative abutment faces is achieved by rotation of the eccentric pin about the eccentric axis thereby rotating the pivot pin about the eccentric axis within the socket whereby the movement of the end walls from the inoperative position to the operative position is a two-part movement comprising pivotal movement about the eccentric axis and lateral displacement of the pivot axis.

2. A platform according to claim 1, whereby an instantaneous contact area between the pivot pin, the eccentric pin, and the pivot mounting provides substantial resistance to the effect of application of any lateral impact load to the end walls.

3. A platform according to claim 1, in which the eccentric pin is manually adjustable.

4. A platform according to claim 1, in which both of the end walls are adjustable between the operative and the inoperative positions by the two-part movement.

5. A platform according to claim 3 wherein the eccentric pin further comprises a knob or lever that provides a means of manually rotating the eccentric pin within the pivot mounting.

* * * * *